US006690112B2

(12) United States Patent
Wood et al.

(10) Patent No.: US 6,690,112 B2
(45) Date of Patent: Feb. 10, 2004

(54) ULTRAVIOLET LAMP POWER SUPPLY AND METHOD FOR OPERATING AT HIGH POWER/REDUCED COOLING USING CYCLING

(75) Inventors: Charles H. Wood, Rockville, MD (US); Ernest G. Penzenstadler, Herndon, VA (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 09/989,037

(22) Filed: Nov. 21, 2001

(65) Prior Publication Data

US 2002/0060529 A1 May 23, 2002

Related U.S. Application Data

(60) Provisional application No. 60/252,428, filed on Nov. 22, 2000.

(51) Int. Cl.[7] ..... H01J 25/50; H05B 37/02

(52) U.S. Cl. ..... 315/39.51; 315/291

(58) Field of Search ..... 315/291, 312, 315/313, 39.51, 289, 290, 209 R, 307, 200 R, 362; 323/905; 363/141; H01J 25/50; H05B 37/02

(56) References Cited

U.S. PATENT DOCUMENTS

| | | | | |
|---|---|---|---|---|
| 3,611,027 A | | 10/1971 | Koinuma et al. | 315/307 |
| 4,121,079 A | * | 10/1978 | Harmon | 219/10.55 B |
| 4,400,660 A | | 8/1983 | Schaefer | 323/270 |
| 4,447,763 A | * | 5/1984 | Iyama et al. | 315/207 |
| 4,481,447 A | * | 11/1984 | Stupp et al. | 315/101 |
| 4,571,552 A | | 2/1986 | Brown | 330/47 |
| 4,667,075 A | | 5/1987 | Sakurai | 219/760 |
| 4,721,890 A | | 1/1988 | Riley, Jr. | 315/224 |
| 4,777,575 A | | 10/1988 | Yamato et al. | 363/21 |
| 4,825,028 A | * | 4/1989 | Smith, deceases | 219/10.55 B |
| 4,873,470 A | | 10/1989 | Myers | 315/240 |
| 4,885,506 A | | 12/1989 | Nilssen | 315/102 |
| 5,085,885 A | | 2/1992 | Foley et al. | 477/38 |
| 5,151,909 A | * | 9/1992 | Davenport et al. | 372/22 |
| 5,239,255 A | * | 8/1993 | Schanin et al. | 323/237 |
| 5,287,039 A | | 2/1994 | Gregor et al. | 315/248 |
| 5,347,236 A | * | 9/1994 | Neuharth et al. | 331/87 |
| 5,459,377 A | | 10/1995 | Zheng | 315/289 |
| 5,559,402 A | * | 9/1996 | Corrigan, III | 315/169.3 |
| 5,642,268 A | | 6/1997 | Pratt et al. | 363/17 |
| 5,677,190 A | * | 10/1997 | Melanson et al. | 436/141 |
| 5,768,898 A | * | 6/1998 | Seok et al. | 62/132 |
| 5,838,114 A | | 11/1998 | Penzenstadler et al. | 315/277 |
| 5,981,925 A | * | 11/1999 | Parosa et al. | 219/715 |
| 6,323,603 B1 | | 11/2001 | Persson | 315/290 |

FOREIGN PATENT DOCUMENTS

| | | | |
|---|---|---|---|
| JP | 56150967 | 11/1981 | H02M/3/28 |
| JP | 1225091 | 9/1989 | H05B/6/68 |

OTHER PUBLICATIONS

"Regulated Microwave Power Supply for Excitation of Electrodeless Lamps", The Review of Scientific Instruments, vol. 42, No. 10, pp. 1535–1537, Oct. 1971.

* cited by examiner

*Primary Examiner*—Don Wong
*Assistant Examiner*—Trinh Vo Dinh
(74) *Attorney, Agent, or Firm*—Antonelli, Terry, Stout & Kraus, LLP

(57) ABSTRACT

A power supply is provided for a lamp system. The power supply may include structure to switch from a high power level to a low power level. The high power level and the low power level together are a cycle that is repeated. The high power level may be higher than the conventional steady-state power level used for the same lamp system.

19 Claims, 5 Drawing Sheets

UV RESPONSE IN VERY HIGH POWER CYCLE MODE

UV RESPONSE IN VERY HIGH POWER CYCLE MODE

BULB TEMPERATURE VARIATION IN VERY HIGH POWER CYCLE MODE

CYCLING AT NORMAL POWER LEVELS

ULTRAVIOLET LAMP POWER SUPPLY AND METHOD FOR OPERATING AT HIGH POWER/REDUCED COOLING USING CYCLING

This application claims priority from U.S. Provisional Application No. 60/252,428, filed Nov. 22, 2000, the subject matter of which is incorporated herein by reference.

BACKGROUND OF THE INVENTION

1. Field of the Invention

The present invention is directed to a method and apparatus (e.g., power supply) for powering a device (e.g., lamps producing ultraviolet light such as electrodeless lamps) at substantially higher power levels than have previously been possible, and/or powering such device (e.g., lamp) at normal power levels but with reduced cooling requirements, or with combinations of power levels higher than conventional power levels with cooling air pressure and flow requirements lower than that conventionally used. The present invention is also directed to a method and apparatus for powering a magnetron at substantially higher power levels and/or reduced cooling requirements. In particular, the present invention is directed to a method and apparatus (e.g., power supply) wherein ultrahigh power levels may be achieved for faster ultraviolet light curing, and/or reduced cooling costs may be achieved.

2. Discussion of Related Art

While it has been desired to utilize higher power levels for increasing speed and productivity in many ultraviolet light curing applications (e.g., for curing polymer material with ultraviolet light), various practical constraints may restrict the ability to go to higher power levels of a power supply, to power the ultraviolet light lamp system, than those conventionally used.

For example, ferro-resonant 50 or 60 hertz power supplies may produce high ripple magnetron current waveforms with peak currents that are much higher than the average current. Rectified alternating current power supplies may produce a magnetron current waveform also with high ripple at 100 or 120 hertz. The upper power level may be limited by the peak component in this waveform. Thus, when powering a magnetron at substantially higher power levels and/or reduced cooling requirements, and the peak current component approaches the upper power limit of the magnetron, disadvantageous magnetron moding may occur.

Another practical constraint is the magnetron cost. Magnetrons operating at 2450 MHz are widely used in the heating or "cooker industry" with power levels up to about 3000 watts. Because of the widespread use, they may be produced in large quantities, and have a relatively low price. However, there are no magnetrons in this price range that are designed to operate over 3000 watts. The cost of magnetrons currently on the market in the over-3000 watt range may be many times more expensive, and are mainly used in radar-type applications.

Another constraint on increasing the power level is magnetron size. Magnetrons currently available to operate at more than 3000 watts are generally water-cooled, which may add a utility requirement that increases complexity and operating cost. Higher power magnetrons are generally much larger in physical size, and may require extensive lamp redesign and larger and less desirable lamp dimensions.

Another constraint on increasing power level is magnetron overheating. The air cooling requirements to maintain reliable operation of present-day magnetrons in use are already aggressive at power levels below 3000 watts of microwave energy. As the power level is increased, the cooling air pressure and flow requirements may increase at a much faster rate than power. FIG. 1 is a graph showing magnetron cooling requirements at a steady state operation. The dotted line represents the cooling for high ripple supply current. Even small increases in steady-state power may require large increases in magnetron cooling.

A still further constraint on power level is bulb overheating. The quartz envelope of microwave-driven electrodeless lamps may require aggressive cooling to operate at high power levels. As the power level is increased, the cooling air pressure and flow requirements increase at a much faster rate than power. FIG. 2 is a graph showing bulb cooling requirements at a steady state operation. The dotted line represents the bulb cooling for a high ripple magnetion current. The cooling power requirements for current state-of-the-art equipment is already large and noisy, and even small increases in power may require large increases in bulb cooling. In many applications, large increases in air cooling are not acceptable.

It was previously known to those skilled in the art that pulsing or flashing a lamp on can allow operation at much higher power levels during the high power cycle phase. This is in essence a pulsed, or flash, technique. There are many references in the literature, and in the market, of examples, such as pulsed Xenon ultraviolet lamps, using variations of this technique. In this technique of pulsing or flashing a lamp on, however, the duration of the "on" pulse, or high-power cycle in Xenon flash lamps, is very short (in the range of 1 ms), with much longer "off" times between the high-power flashes. The rates of each "on-and-off" period must be relatively very fast in order to prevent plasma extinction that will occur in a fraction of a second, or the apparatus must have special ignition schemes to re-ignite the bulb for each flash. Microwave-powered, medium-pressure electrodeless lamps, and linear medium-pressure arc lamps, used for ultraviolet curing, may require extended delays before the lamp can be restarted if the plasma in the hot bulb is allowed to extinguish. Restarting the bulb plasma may then become extremely difficult and time consuming, requiring a significant waiting period to allow for the bulb to cool down, and the fill within the bulb to condense.

U.S. Pat. No. 5,838,114 to Penzenstadler et al., the subject matter of which is incorporated herein by reference, addresses the problem of quickly restarting an electrodeless lamp. A low power level or simmer mode may be employed. This allows the lamp to be momentarily switched to a much lower power level, with less than 10% of full power operation, and allows the lamp to be switched back to full power operation at any time. The patent teaches switching from a relatively high power to a relatively low power to obtain the quick restart feature. The patent also discloses a power supply that achieves this switching from the relatively high power, supplied to the magnetron in a full power mode, to the relatively lower power, where the lower power is of a magnitude to generate sufficient microwave radiation to maintain the lamp in an ignited condition. The patent further discloses the "relatively high power" as a normal power level as conventionally used in the art.

U.S. Pat. No. 5,838,114 provides no disclosure as to modification of bulb cooling requirements in the cycling mode.

U.S. Pat. No. 5,838,114 discloses cycling wherein the relatively high power mode is the power level that is conventionally used. The highest power electrodeless lamp systems currently available for commercial use are 6-inch and 10-inch linear lamp systems that use magnetrons desired to operate at about 2800 watts. With a typical highly coupled linear lamp system, this yields about 450 average watts/inch on the 6-inch long lamp system, and 560 average watts/inch using two of the same magnetrons each operating at 2800 watts on 10-inch systems.

FIG. 3 is a chart showing the relative UV light output for several systems where systems A and B represent currently available lamp systems for commercial use. FIG. 3 shows power levels of 1800 W rf and 2800 W rf, respectively, for Systems A and B, which are power levels of the magnetron output. As the magnetrons are about 70% efficient, the power levels of the magnetron are about 70% of the power levels of the power supplied to the magnetron from the power supply. Throughout this disclosure, the reported quantitative power levels are power levels of the magnetron output, discussed as power output, which is about 70% of the actual output of the power supply. That is, the power level from the power supply itself is 30% higher.

SUMMARY OF THE INVENTION

Embodiments of the present invention may provide a power supply for a lamp system. The power supply may include structure to switch from a high power level to a low power level. The high power level and the low power level together are a cycle that is repeated. The high power level is higher than the conventional steady-state power level used for the same lamp system. The power supply may provide low ripple power.

The lamp system may be an electrodeless ultraviolet lamp system with an electrodeless bulb. The lamp system may also be an arc lamp system for powering an arc lamp outputting ultraviolet light.

Embodiments of the present invention may also provide a power supply to provide reduced cooling requirements for the lamp system. The power supply may include structure to switch from a first power level to a second power level lower than the first power level. The first and second power levels together form a cycle that is repeated. The power supply may also include structure to cool the lamp system where the level of cooling of the lamp system is reduced as compared to cooling requirements of the same lamp system. The power supply may operate in a steady-state condition at the first power level.

Embodiments of the present invention may still further provide a method of operating a power supply for powering a lamp system. The method may include switching the power supplied by the power supply to the lamp system between a high power level and a low power level. The high power level and the low power level together form a cycle that is repeated. The high power level is larger than a conventional steady-state power level for powering the lamp system.

Other embodiments, advantages and salient features of the invention will become apparent from the following detailed description taken in conjunction with the annexed drawings, which disclose preferred embodiments of the invention.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and the invention is not limited thereto.

The following represents brief descriptions of drawings in which like reference numerals represent like elements and wherein.

DETAILED DESCRIPTION OF PREFERED EMBODIMENTS

Figure 1:
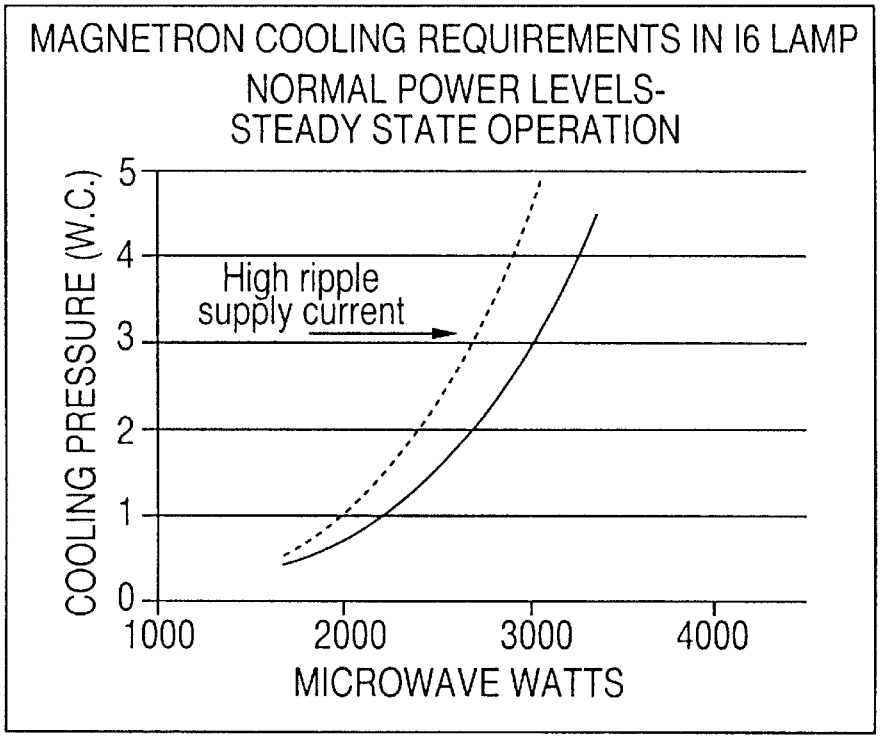
FIG. 1 is a graph showing cooling pressure versus microwave watts.

The following detailed description, example values may be given although the presented invention is not limited to the same.

Embodiments of the present invention may operate at very high power levels by alternating the very high power levels with periods of very low power levels. Thus, embodiments of the present invention may include a power supply having alternating very high power levels and very low power levels so as to provide a cycle of a high level of power and a low level of power. This cycle may be repeated. By cycling in this manner, the power may be increased to extend beyond the current state of the art with respect to both the upper power level and the lower power level in an alternating power cycle. Thus, using this cycling, the high power level in operating a device (e.g., an ultraviolet lamp system) may be greater than that in a steady-state operation of the power supply operating the same device.

Embodiments of the present invention may achieve the advantage, when operating in a cycling mode of alternating normal power level and low power level, of cycling the lamp system at normal power levels but with reduced cooling requirements. When operating in this cycling mode, but at normal power levels at the high power level, the cooling air pressure and air flow volume for the lamp may be operated at a small fraction of the cooling required for steady-state operation at the normal power levels. Moreover, since reduced cooling air pressure and air flow volume can be achieved, efficient ultraviolet operation of the ultraviolet bulb can be maintained by maintaining optimum bulb envelope temperatures.

Embodiments of the present invention (e.g., power supply and method of use thereof), when utilized in a curing lamp system for curing, for example, polymer materials (e.g., either a body of the polymer material or a film thereof on a body) may be particularly advantageous when used in curing lamp systems that utilize a quick restart feature, which are most useful for step-and-repeat type processing, and in applications that require transferring and positioning of the product to be exposed to ultraviolet light. When the product is positioned for curing by exposure to ultraviolet light, the lamp may be switched to higher power for fast curing. According to embodiments of the present invention, which utilize substantially higher power levels than have previously been possible, increased productivity or throughput of a curing process or machine may be achieved.

Embodiments of the present invention may be different from pulsed or flash lamp systems as previously known. In the pulsed or flash lamp system, pulses occur many times per second; the flash time on is much less than one second, e.g., 1 ms. According to embodiments of the present invention, the "on" portion, having high power level, may be for multiple seconds; for example, the high power level may be for at least one second (for example, 4–6 seconds) according to at least one embodiment of the present invention.

It was discovered that with a specially designed power supply operating under specific conditions, it is possible to overcome power limiting issues in a very practical and reliable manner. With the appropriate sequencing of cycle time and cooling rates, the bulb and magnetron temperatures may remain in a suitable range for long life, and the ultraviolet response may be instantaneous when switching to very high power. It was discovered that using a special high power solid state power supply design with low ripple current, the internal heating of the magnetron anode core may be reduced. In comparison, a magnetron operating with a ferro-resonant supply operating at the same average current and same power level but at high ripple anode current waveform operates much hotter. FIG. 1 shows the cooling requirements for a power supply having a high ripple current (shown by the dotted line) as compared with a power supply according to an embodiment of the present invention having the high and low power levels (shown by the solid line).

Figure 2:
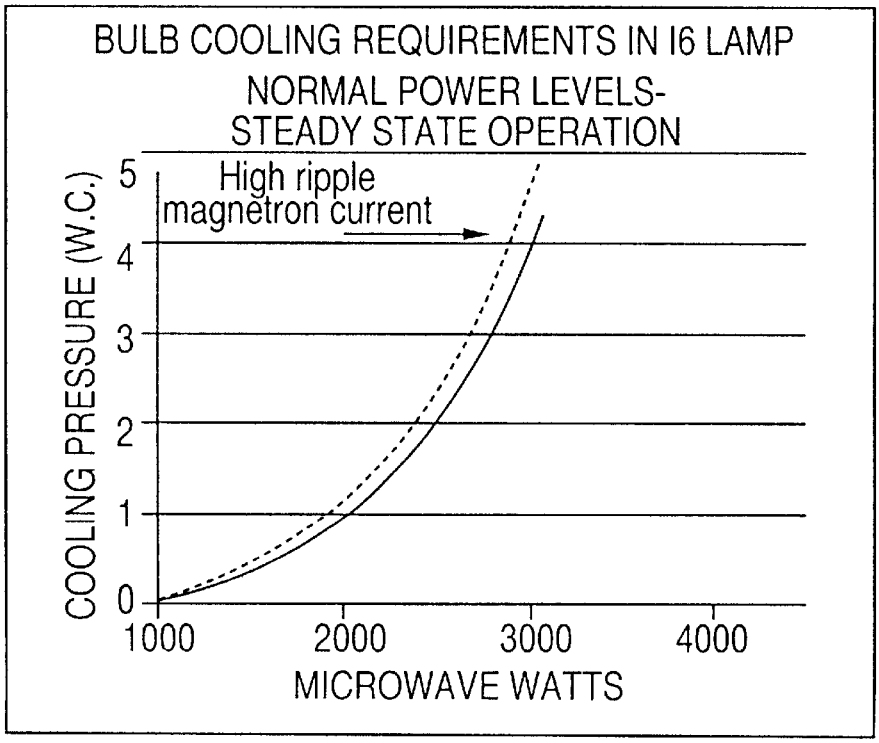
FIG. 2 is a graph showing cooling pressure versus microwave watts.
Figure 3:
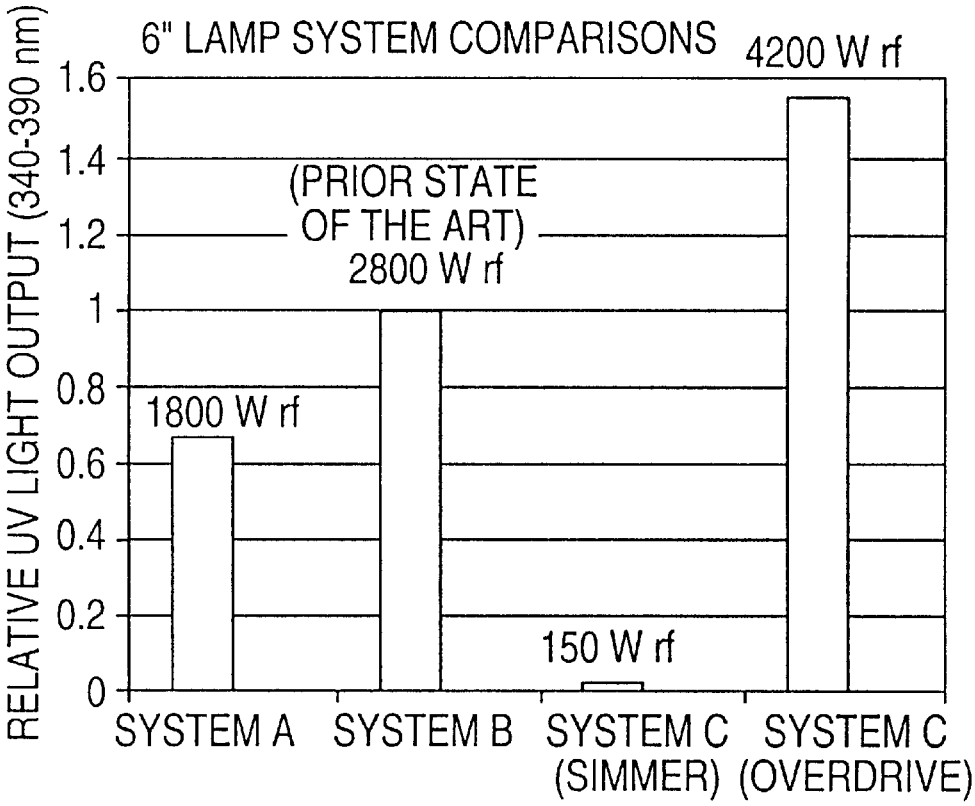
FIG. 3 is a chart showing relative UV light output for a plurality of systems.

It was also discovered that with a power supply having low-ripple and with cycling, as in embodiments of the present invention, the peak bulb envelope temperatures may be reduced at all power level. In other words, cooling requirements may be reduced with the cycling to a very low level even with cycles allowing normal power operation for step-and repeat curing applications. This becomes more important at the higher power levels by reducing cooling requirements for extending bulb life. FIG. 2 shows cooling requirements using a high ripple magnetron current from a high ripple magnetron current source (shown by the dotted line) as compared to the special solid state power supply design according to an embodiment of the present invention (shown by the solid line).

Figure 4:
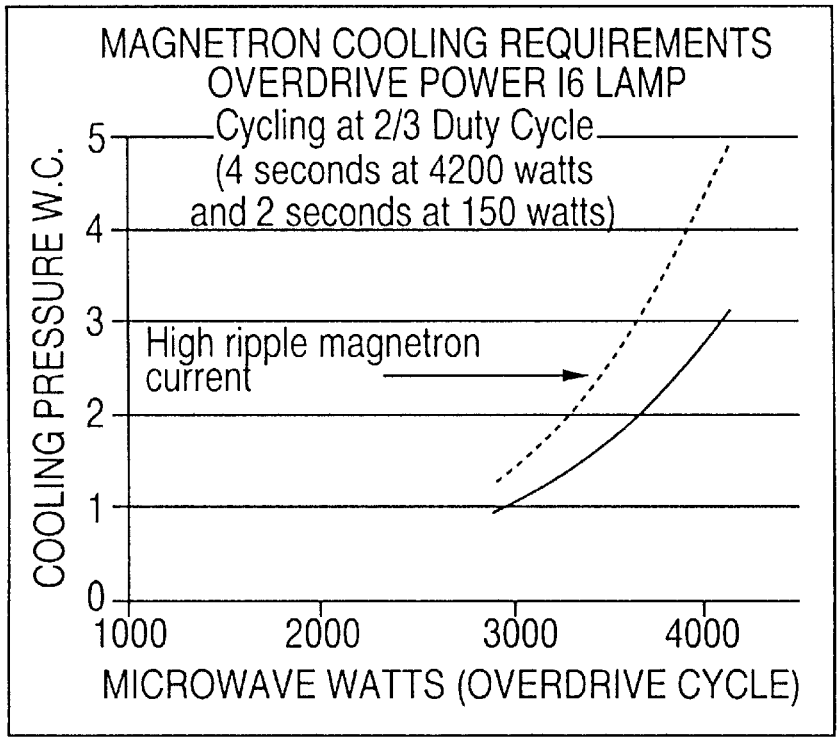
FIG. 4 is a graph showing cooling pressure versus microwave watts.

It was also discovered that power levels for electrodeless lamps operating in a cycling mode could be substantially increased from current state-of-art power levels with the use of the specially designed power supply. A solid-state power supply has been designed with increased power capability. FIG. 4 is a graph showing a system operating up to 4200 watts output from the magnetron on a ⅔ cycle (4 seconds of 4200 watts and 2 second at 150 watts) where the solid line shows results of an embodiment of the present invention.

The power supply according to embodiments of the present invention may incorporate adjustable power levels for adjusting to various conditions. The power supply may also be designed to provide low-ripple magnetron anode current. The power supply may also incorporate special peak anode voltage and current limiting electronic circuits to prevent magnetron moding at highest power levels. Moreover, the power supply may incorporate a very low power mode for alternating between high and low power levels, which is lower than previously obtained with conventional ferro-resonant power supplies. The power supply may have programming capability to prevent and protect the system from operating at elevated power levels longer than design recommendations. Also, the power supply may include control connections for external control so that the user's application or user's machine may automatically control the lamp cycle timing.

The power level potential for the power supply may be increased by increasing magnetron current to a standard magnetron. As an example, by increasing the magnetron current from 0.84 amps to 1.25 amps for a conventional magnetron in an electrodeless system, the microwave power output may increase from a normal 2800 watts to 4200 watts. This is a 50% increase in power over the current state of the art in electrodeless lamp microwave power levels. FIG. 2 shows the bulb cooling requirements where the solid line shows results of an embodiment of the present invention. Even higher power levels may be possible with cycle durations less than 5 seconds.

Three variables may exist in operation of a power supply for driving the ultraviolet lamp according to embodiments of the present invention. These variables may include overdrive (which is the extra high power part of the cycle); time at overdrive; and duty cycle (which is a ratio of the time on high power to the sum of the time on high power and the time off high power at low power). This ratio may be multiplied by 100%.

The average power level may be the aforementioned duty cycle multiplied by the power level. According to embodiments of the present invention, the average power level need not be increased, while the peak power (high power as discussed previously) may be increased to achieve higher power levels from the magnetron. As one example, the average power level may be maintained at about 1 while still achieving increased operating power. For example, with use of the same lamp with the power supply operating according to the present invention (i.e., with the power supply having relatively high and relatively low power levels) with low ripple, the operating power may be increased 50%.

That is, it was discovered that operation at extra high power levels, which was not possible with conventional power supplies, could be obtained with a power supply having low ripple current with the power supply being cycled between relatively high and relatively low levels. Moding or internal arcing in the magnetron may cause magnetron damage and may prevent a ferro-resonant type power supply from operating at steady-state levels of the same extra high power level.

To accomplish the higher power level without causing a large increase in cooling requirements, and to prevent overheating the magnetron and bulb components of the ultraviolet lamp, the power supply may switch to very low power levels for the reduced power phase of the cycle. During the reduced power phase, forced cooling may remain on and operating temperature of the critical components of the magnetron and the bulb quickly drop, which then allows a repeat cycle of an overdrive high power level. Alternating between the overdrive high power levels and very low power levels may provide the potential for a more powerful ultraviolet light curing system design with faster throughput for cycling or step-and-repeat type applications. Due to the higher intensity, faster curing times may be achieved. Moreover, improved efficiency, such as improved efficiency in curing during step-and-repeat curing operations, may be achieved.

Figure 5:
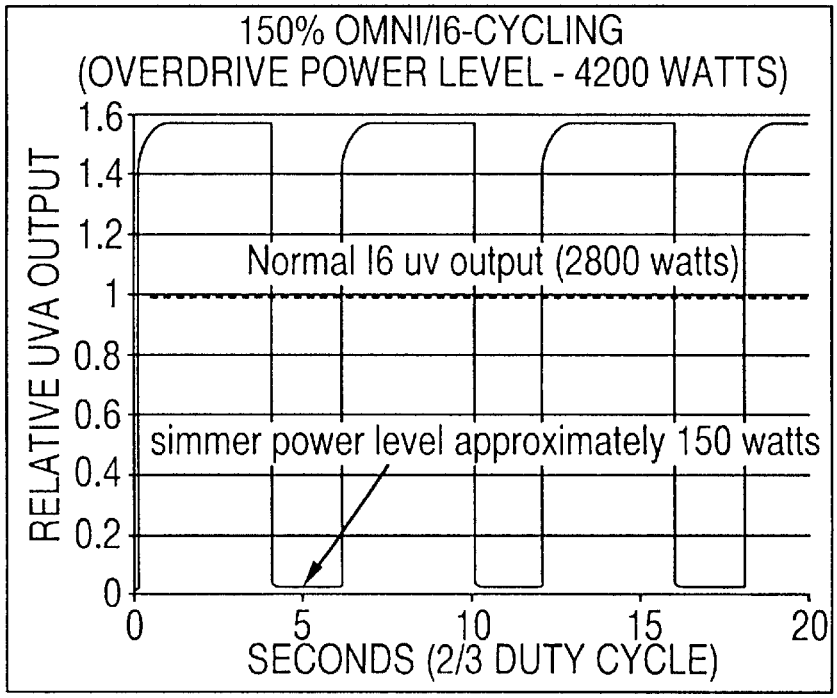
FIG. 5 is a timing diagram showing relative UVA output.

FIG. 5 is a timing diagram showing the relative UVA output in a very high power cycle mode. FIG. 5 shows the greater intensity achieved according to an embodiment of the present invention where the relative increase in ultraviolet light output is at least 50%. Normal ultraviolet light output of 1.0 on the relative Y scale (in FIG. 5) may represent the normal steady-state power operation at 2800 watts of magnetron power.

The reduced power phase of the cycle may be at very low power levels, at a level that is high enough so that the bulb plasma in the electrodeless lamp does not go out but at a level which is, for example, less than 10% of normal power, with the overdrive being 1.5–2.0 times the normal power. The lamp may not go out because of use of the low ripple power supply, and since the low level power is at a power high enough to avoid extinguishing the plasma.

Figure 6:
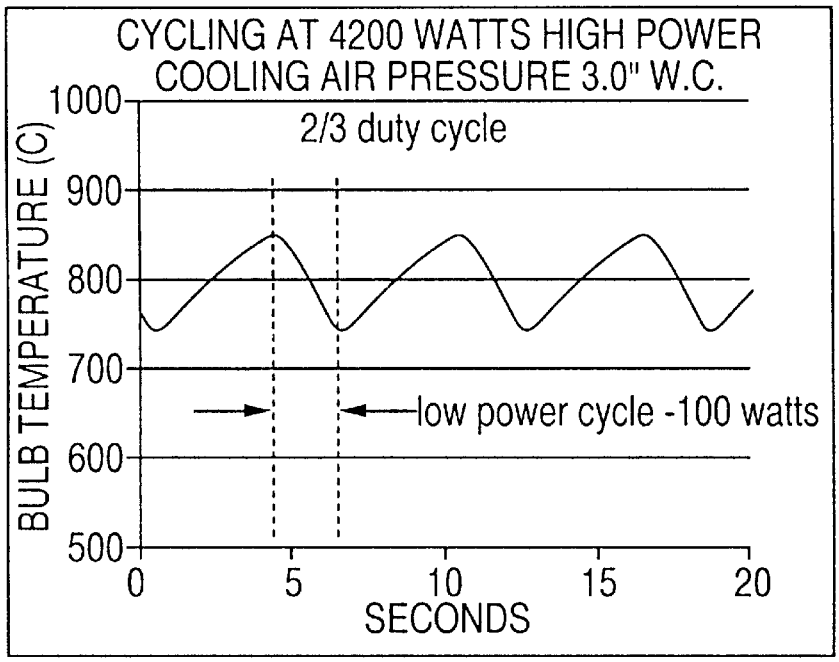
FIG. 6 is a timing diagram showing bulb temperature.

The higher overdrive power levels are practical in a cycling mode because peak bulb temperatures can be maintained in a normal temperature range without requiring higher levels of cooling. FIG. 6 is a timing diagram showing the typical variation in bulb temperature with operation at 4200 watts in the high power mode cycling at ⅔ (66.7%) duty cycle. The same 3.0 inch cooling pressure was used as normally required in a lamp operating at 2800 watts. The peak bulb temperature may remain in a normal range under 900° C. in operation according to an embodiment of the present invention with a peak power of 4200 watts, similar to operating at 2800 watts.

It was also discovered that in order to achieve very low "simmer" power levels, for best cool-down rates, low ripple magnetron anode current may be preferred. With low ripple magnetron current, it was discovered that the lower limit for low power could be further reduced without the plasma in the bulb completely extinguishing which is a limiting factor with normal high-ripple supplies. When the low-ripple power supply is instantly switched from a very high power level to this very low "simmer" power level, the plasma would not completely extinguish, thus allowing switching back to very high power on command. Cycle operation then becomes 100% reliable even with extreme change in power levels and hot bulbs at high pressure that would normally extinguish the plasma when using other power supplies.

The vapor pressure of the bulb fill may also be maintained when operated with very low power simmer durations of up to about 5 seconds. With aggressive air cooling, commonly used on high power electrodeless lamps, the bulb fill may quickly start to cool and the vapor pressure and ultraviolet output may start to decline after about 5 seconds. The lamp may not respond instantly to high power if the envelope and the fill materials cool more than about 5 seconds. The duration time of low power, for efficient operation, may be further extended if the cooling air is modulated, reduced or cut off completely during the very low power phase of the cycle.

It was also discovered that cycling between normal power levels and very low power levels may reduce the cooling requirements to a very low level even with duty cycles allowing normal power operation for step-and-repeat curing applications. In some ultraviolet light curing applications, it may be advantageous to minimize the system cooling requirements. This can be achieved according to embodiments of the present invention, utilizing the cycling as discussed previously, even with a high power level that is the same as conventional power levels. That is, this aspect of the present invention may operate in a cycle mode between normal power levels and very low power levels in each cycle, and with reduced cooling requirements. When operated in a cycling mode according to embodiments of the present invention, but at normal power levels, the cooling air pressure and air flow volume for the lamp may be operated at a small fraction of the cooling required for steady-state operation at normal power levels.

Another reason for reducing the cooling air pressure and flow when cycling at normal power is to maintain efficient operation of the ultraviolet bulb of the electrodeless lamp by maintaining optimum bulb envelope temperatures. If the cooling is not reduced for cycling operation then the bulb may become overcooled and ultraviolet curing performance may be diminished. The lamp system is sensitive to overcooling; therefore, the cooling and duty cycle may need to be matched to maintain efficient operation. In order to provide instant ultraviolet response in the first few seconds when the lamp cycles to high power, the cooling and the duty cycle may need to be closely matched. The virtually instant ultraviolet response of the extra high power cycle mode shown in FIG. 5 may also be obtained at normal power levels up to a relative ultraviolet output of 1.0 when the cooling is matched to the duty cycle requirements.

Figure 7:
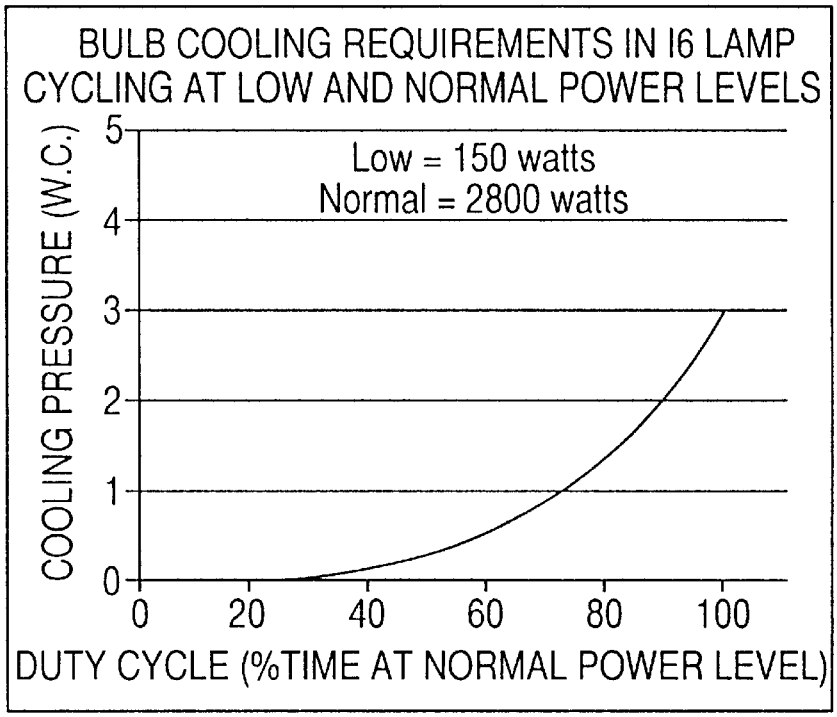
FIG. 7 is a graph showing cooling pressure versus duty cycle.

The extent of the cooling reduction required may be dependent on the duty cycle utilized according to embodiments of the present invention. The relationship between lamp power and the duty cycle and cooling requirements for the bulb has been investigated. The relationship for normal power (2800 watts) and duty cycle is shown in FIG. 7. The steep exponential function to the curve demonstrates the strong influence that duty cycle has on air requirements.

There is no practical time limit for duration of a cycle. If the lamp were to be cycled repetitively at normal power level for durations 1/10 as long as a cycle of 4.0 seconds at high power and at low or simmer power levels for 2.0 seconds (i.e., high power for 0.4 seconds and lower power for 0.2 seconds) that would still be considered a 67% duty cycle. However, maximum duration of high power is limited up to about 7 seconds maximum at cycles with normal power. If the cycle is much over 7 seconds, the bulb begins to overheat, and an increase in air pressure and flow above that shown in FIG. 7 may be required to maintain long bulb life.

The example of 67% duty cycle shows that only one-third the normal cooling pressure and flow is required. Note that at duty cycles of 50% the cooling pressure and flow requirements may be reduced to 1/10 of the steady-state, non-cycling operation. At this point (1/10 of the cooling pressure and flow requirements of steady-state, non-cycling operation) the noisy centrifugal-type blowers normally used may no longer be required. Inexpensive, quiet, low-profile small fans may be adequate. At duty cycles of around 30%, virtually no forced air cooling may be required for the bulb.

High-power microwave powered lamps typically have the magnetron and the bulb cooled in series using the same air supply. The lamp magnetron cooling requirements were found to also decrease on a similar curve as the bulb requirements, so that, therefore, the same small fan can still be used to cool the magnetron and the bulb, when utilizing the cycling according to embodiments of the present invention even when using the same air supply to cool the magnetron and the bulb.

The power supply control logic for this new type of cycle operation may be programmed to control duty cycle and maintain maximum duration within preferred design parameters.

Accordingly, by operating under cycling at relatively high power and very low power levels, the high power level may be much higher than conventional power levels while utilizing the same lamp system including the same magnetron. This provides an advantage that a greater intensity of, e.g., ultraviolet light output from a lamp system (either an electrodeless bulb lamp systems or an arc lamp) may be achieved. The maximum power level may be increased using the cycle of high and low power levels without extinguishing the bulb plasma where the power supply is a low ripple power supply. In addition, cooling requirements (of the magnetron and of the bulb) may be reduced even when operating at conventional power levels as the high power level when using the cycling between high power and low power levels according to embodiments of the present invention. This invention has a beneficial effect in ultraviolet processing systems having exposure to ultraviolet light such as ultraviolet curing and photolithography; and has a particularly beneficial effect in step-and-repeat processes using ultraviolet processing equipment (to provide additional power levels). These processes include semiconductor processing, DVD and other optical data disc optical processing, etc.

Figure 8:
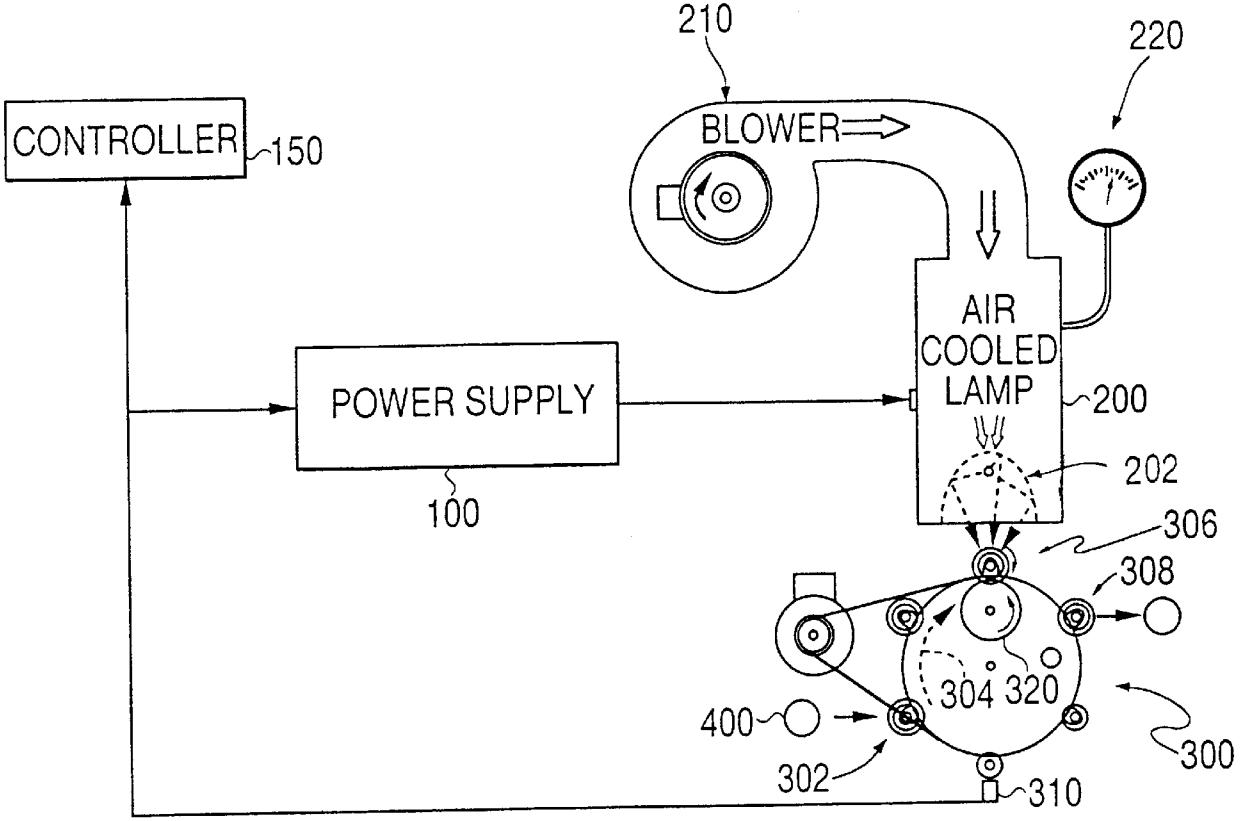
FIG. 8 illustrates a curing apparatus according to an example embodiment of the present invention.

FIG. 8 illustrates a curing system according to an example embodiment of the present invention. Other embodiments and configurations are also within the scope of the present invention. More specifically, FIG. 8 shows a power supply 100 coupled to an air cooled lamp system 200 and to a controller device 150. The controller device 150 may control operations of the power supply 100.

The power supply 100 may include the properties, structures and functionality discussed above such as structure to switch from a high power level to a low power level where the high power level and the low power level together are in a cycle that is repeated. The high power level is higher than a conventional steady-state power level. The power supply may provide low ripple power as discussed above.

The air cooled lamp system 200 may be an electrodeless ultraviolet lamp system (such as a magnetron 202) having an electrodeless bulb or may be an arc lamp that outputs ultraviolet light. The lamp system 200 may include or may be coupled to a blower device 210 and/or a lamp cooling pressure regulating device 220. As indicated above, the level of cooling of the lamp system 200 may be reduced by use of the blower device 210 and/or the lamp cooling pressure regulating device 220 when used with the power supply 100.

FIG. 8 additionally shows a rotary machine 300 that rotates about a central axis. A material (device) 400 to be cured may be placed onto the rotary machine 300 at location 302. The rotary machine 300 may rotate in the direction of arrow 304 and stop at an indexed areas. Indexing may be accomplished by use of a position sensor 310 coupled to the controller 150 (or other means). When the material 400 is properly indexed under the lamp system 200 at a location 306, the rotary machine 300 may stop rotation and the material may be rotated (or adjusted) by use of a rotary device 320. That is, the rotation device 320 may move, rotate and/or adjust the material 400 when it is at location 306 such that all or a portion of the material may be cured by the ultraviolet radiation of the lamp system 200. The rotary machine 300 may then rotate in the direction of arrow 304 and the material may be removed at location 308.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed:

1. An apparatus comprising a lamp system and a power supply for operating the lamp system at a high power level and a low power level, the power supply switching from the lamp system operating at the high power level to the lamp system operating at the low power level, the high power level and the low power level together being a cycle that is repeated during operation of the lamp system, the high power level being higher than an industry standard steady-state power level used for the same lamp system, wherein a bulb of the lamp system remains ON during the cycle.

2. The apparatus according to claim 1, wherein the power supply provides low ripple power.

3. The apparatus according to claim 1, wherein the lamp system comprises an electrodeless ultraviolet lamp system having an electrodeless bulb.

4. The apparatus according to claim 1, wherein the lamp system comprises an arc lamp system for powering an arc lamp outputting ultraviolet high.

5. The apparatus according to claim 1, wherein the lamp system produces ultraviolet light.

6. An apparatus comprising a lamp system and a power supply to provide reduced cooling requirements for the lamp system, the power supply switching from the lamp system operating at a first power level to the lamp system operating at a second power level lower than the first power level, the first and second power levels together forming a cycle that is repeated during operation of the lamp system, and the power supply to cool the lamp system, wherein the level of cooling of the lamp system is reduced as compared to cooling requirements of the same lamp system wherein the power supply operates in an industry standard steady-state condition at the first power level, wherein a bulb of the lamp system remains ON during the cycle.

7. The apparatus of claim 6, wherein the power supply provides low ripple power.

8. The apparatus of claim 6, wherein the lamp system comprises an electrodeless ultraviolet lamp system having an electrodeless bulb.

9. The apparatus of claim 6, wherein the lamp system comprises an arc lamp system for powering an arc lamp outputting ultraviolet light.

10. A method of operating a lamp system at a high power level and a low power level, including switching power supplied by a power supply to the lamp system from a high power level to a low power level, the high power level and low power level together forming a cycle that is repeated, the high power level being larger than an industry standard steady-state power level for powering the lamp system, wherein a bulb of the lamp system remains ON during the cycle.

11. The method according to claim 10, wherein the power system provides low ripple power.

12. The method according to claim 10, wherein the lamp system comprises an electrodeless bulb, and wherein the power supply drives a magnetron producing microwaves for powering the electrodeless bulb.

13. The method according to claim 10, wherein the lamp system comprises an arc lamp.

14. A method of operating a lamp system at a high power level and a low power level, the method comprising switching power supplied to the lamp system by a power supply from a high power level to a low power level, the high power level and low power level together forming a cycle that is repeated, and cooling the lamp system, wherein a level of cooling is reduced as compared to the level of cooling the lamp system when using a power supply that is operating under industry standard steady-state conditions at the high power level, wherein a bulb of the lamp system remains ON during the cycle.

15. The method according to claim 14, wherein at least one of the cooling air pressure and cooling air flow volume is reduced to reduce the level of cooling.

16. The apparatus according to claim 1, wherein the lamp system comprises a magnetron.

17. An apparatus comprising:

a lamp system including a magnetron and a bulb, a power supply to provide low ripple power to the lamp system and to power the lamp system at a high power level and a low power level, the power supply to adjust power to the lamp system in a cyclical manner from the high level to the low level and back to the high level, the higher power level and the low power level together being a cycle that is repeated during operation of the lamp system, wherein the magnetron and bulb remain ON when powered from the high level to the low level.

18. The apparatus of claim 17, wherein the lamp system comprises an electrodeless ultraviolet lamp system having an electrodeless bulb.

19. The apparatus of claim 17, wherein the lamp system comprises an arc lamp system for powering an arc lamp outputting ultraviolet light.

* * * * *